US005724081A

United States Patent [19]

Maechler et al.

[11] Patent Number: 5,724,081

[45] Date of Patent: Mar. 3, 1998

[54] MULTI-COLOR PRINT HEAD FOR AN INK-JET PRINTER

[75] Inventors: Gordian Maechler, Altendorf; Jürg Geissmann, Zurich, both of Switzerland

[73] Assignee: Pelikan Produktions AG, Egg, Switzerland

[21] Appl. No.: 402,577

[22] Filed: Mar. 13, 1995

[51] Int. Cl.[6] ..... B41J 2/175

[52] U.S. Cl. ..... 347/87

[58] Field of Search ..... 347/86, 87, 84, 347/43, 85

[56] References Cited

U.S. PATENT DOCUMENTS 4,771,295 9/1988 Baker et al. .
4,785,314 11/1988 Terasawa et al. .

FOREIGN PATENT DOCUMENTS 0 560 729 5/1993 European Pat. Off. .

*Primary Examiner*—Huan H. Tran
*Attorney, Agent, or Firm*—Fay, Sharpe, Beall, Fagan, Minnich & McKee

[57] ABSTRACT

A print head includes a plurality of receiving chambers each for receiving an ink cartridge having an ink of a predetermined color. Each ink cartridge is separately replaceable. A common pump element on the housing of the print head is provided to recharge the ink cartridges after replacement.

19 Claims, 2 Drawing Sheets

MULTI-COLOR PRINT HEAD FOR AN INK-JET PRINTER

BACKGROUND OF THE INVENTION

This invention relates generally to a multi-color print head for an ink jet printer, and, in particular, to an ink jet print head with several chambers for different colors, each having a replaceable ink cartridge.

Disposable print heads which contain several chambers with an ink supply for multi-color printing are well-known. Each chamber communicates with the channels of a nozzle plate for the respective color. When the ink supply of one chamber is exhausted, the entire head is replaced. For single-color print heads, it is known from European Patent No. EP-A-560 729 that a separate, replaceable ink cartridge can be inserted in the print head.

SUMMARY OF THE INVENTION

Generally speaking, in accordance with the present invention, a multi-color print head for an ink jet printer is provided. The print head includes a housing having a plurality of receiving sections or chambers. At least two ink cartridges may be respectively positioned in the receiving chambers for storing inks of different colors. Each ink cartridge includes a vent opening for feeding air into the housing. A pump element creates an over pressure in the respective vent openings after at least one of the cartridges has been inserted in its receiving chamber.

In accordance with another embodiment of the invention, a multi-color print head is provided for an ink jet printer. The print head includes a housing having a replaceable ink cartridge with at least two chambers for storing inks of different colors. Each chamber has a vent opening for feeding air into the chamber. A pump element creates an over pressure at the vent openings after the ink cartridge has been inserted in the housing.

Accordingly, it is an object of the present invention to provide an improved multi-color print head.

Another object of the invention to provide a multi-color print head with a replaceable ink cartridge for each color, which is both economically and ecologically sound.

Still another object of the invention to provide a multi-color print head with a pump element for providing a reliable restart of printing after replacement of an ink cartridge.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

Because the ink cartridges of the present invention may be replaced individually, only one cartridge needs to be replaced at a time, namely the one whose ink supply is exhausted. The less frequently used colors may thus be better utilized and the lifetime of the nozzle plate of the print head may be fully utilized. The cartridges may be replaced 10 to 20 times per color. Alternatively, it is possible to provide only a single replaceable cartridge with several chambers for the various colors so as to simplify replacement. A pump element positioned in the print head of the present invention guarantees reliable restart after replacement. If the pump element is integrally attached to a cover, which seals the housing, the cartridges can be manufactured more economically. Installing a common pump element for all vent openings in the cover is especially economical.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
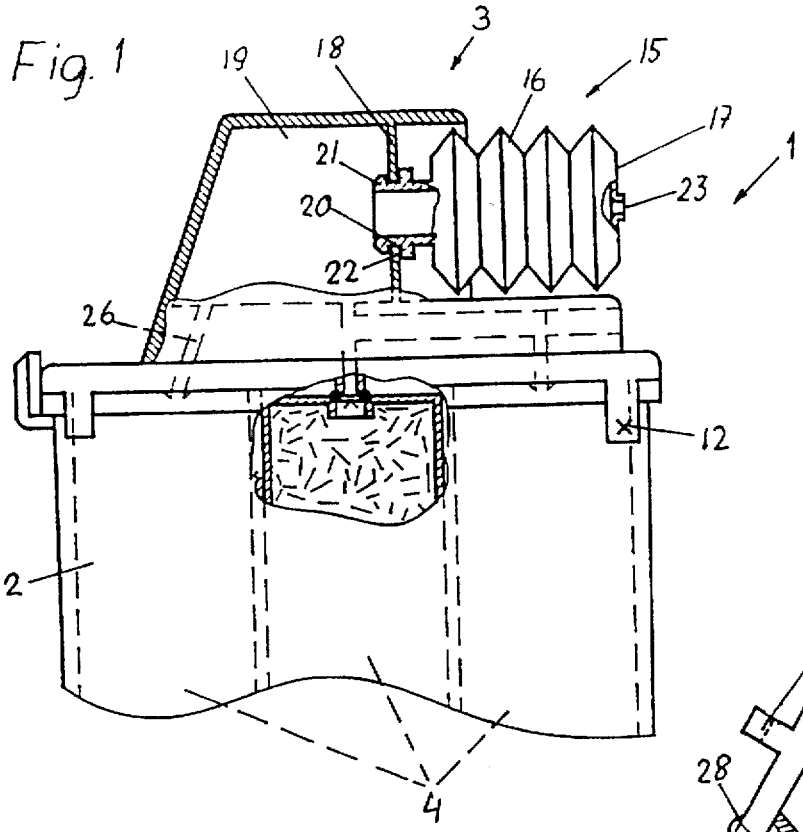
FIG. 1 is a partial sectional elevational view of a multi-color print head for an ink jet printer in a closed position constructed in accordance with the present invention.

Referring to FIG. 1, a print head, generally indicated at 1 and constructed in accordance with a first embodiment of the present invention is depicted. Print head 1 is not shown in its entirety. Rather, only the upper part of housing 2 with a cover 3 and an ink cartridge in the form of three inserted ink cartridges 4 are depicted. Each ink cartridge 4 contains an ink of a different color. At the opposite lower side of the housing, a tubular connection piece of housing 2 is associated with each cartridge 4. This connection piece communicates with the channels of the respective color of a nozzle plate. The connection pieces are sealingly inserted into an opening of cartridge 4 as described for example in EP-A-560, 729.

Figure 2:
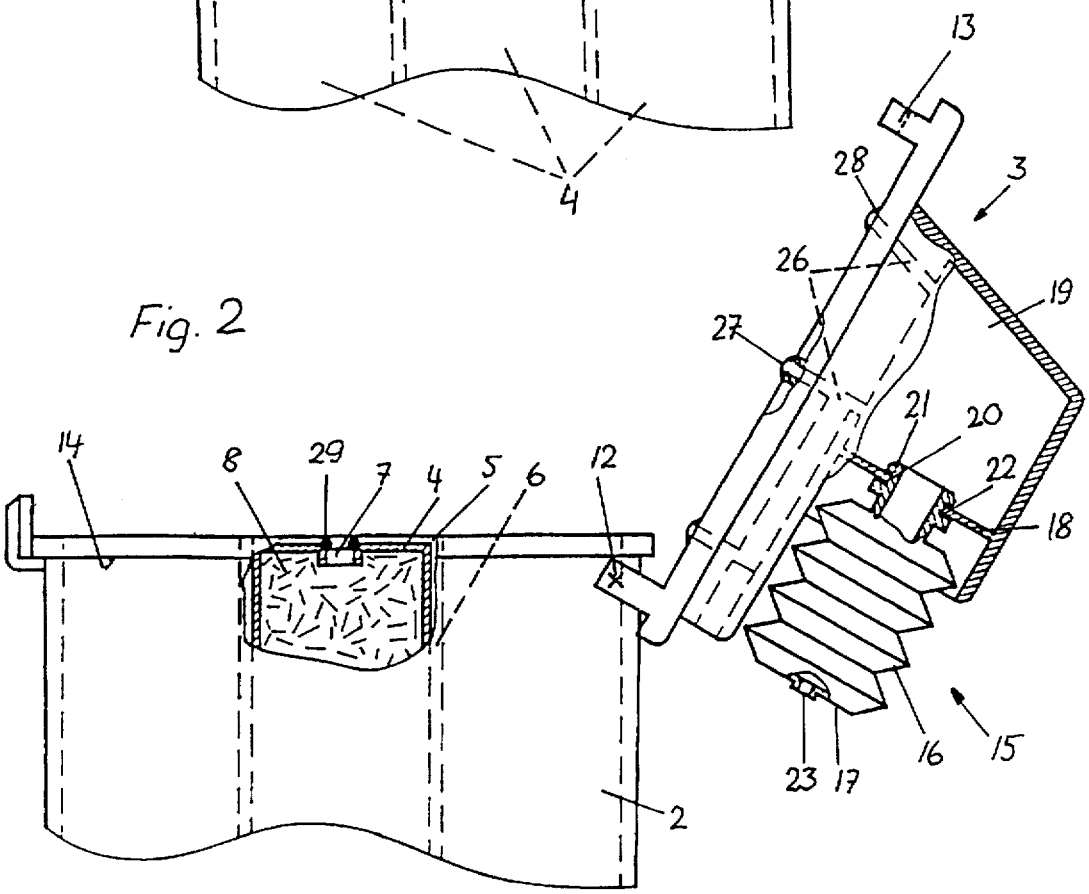
FIG. 2 is a partial sectional elevational view of the print head of FIG. 1 shown with the cover in an open position.

Cartridges 4 are inserted in chambers 5 of housing 2. Chambers 5 are separated from one another by partitions 6. Each cartridge 4 has a vent opening 7 on top. The ink is received in any way common in the art (e.g., in a foam body 8). One edge of cover 3 is connected to housing 2 by means of a hinge 12. At the opposite edge of cover 3, a catch element 13 is provided in the form of two hooks (as shown in FIG. 2), which latches onto underside 14 of a flange of housing 2. A pump element 15 is included as part of cover 3.

Pump element 15 is formed with an elastomeric bellows 16 with a handle surface 17 for pressing by a finger. For this purpose, a wall 18 of a cavity 19 in cover 3 has a bore 20. In this manner, wall 18 is snapped into a stud-like protrusion 21 of bellows 16 with a circumferential groove 22. The interior of bellows 16 communicates freely with cavity 19. Handle surface 17 has free through-opening 23 at its center. Cavity 19 communicates through channels 26 with three openings 27 having dome-shaped protrusions 28 on the underside of cover 3. When cover 3 is closed, channels 26 are sealed against vent openings 7 of cartridges 4, each one by means of a sealing element 29 (e.g. an O-ring). Thus, when cover 3 is closed, openings 7 communicate with cavity 19.

When the ink supply of a specific cartridge has been used up, cover 3 is opened. Empty cartridge 4 is removed and replaced with a fresh cartridge containing ink of the desired color and cover 3 is then closed. Opening 23 is closed automatically by pressing on handle surface 17 with a finger. The air in the interior of bellows 16 is displaced into cavity 19 so that an overpressure is created in all three cartridges 4 through channels 26 and vent openings 7. The pumping process is continued until ink emerges from the nozzles that are associated with a replaced cartridge 4. The air that was collected in the nozzle channels, which impedes the flow of ink, is then flushed out. Thereafter, print head 1 is again ready to operate.

In an alternative embodiment, dome-like protrusions 28 may be integrally attached to cartridges 4 at vent openings 7, while sealing element 29 formed by O-rings may be correspondingly attached to cover 3. This has the advantage that cartridges 4 may be manufactured still more economically. If the O-rings are very soft, they can also seal directly against the flat outer surface of the front wall of cartridges 4.

Figure 3:
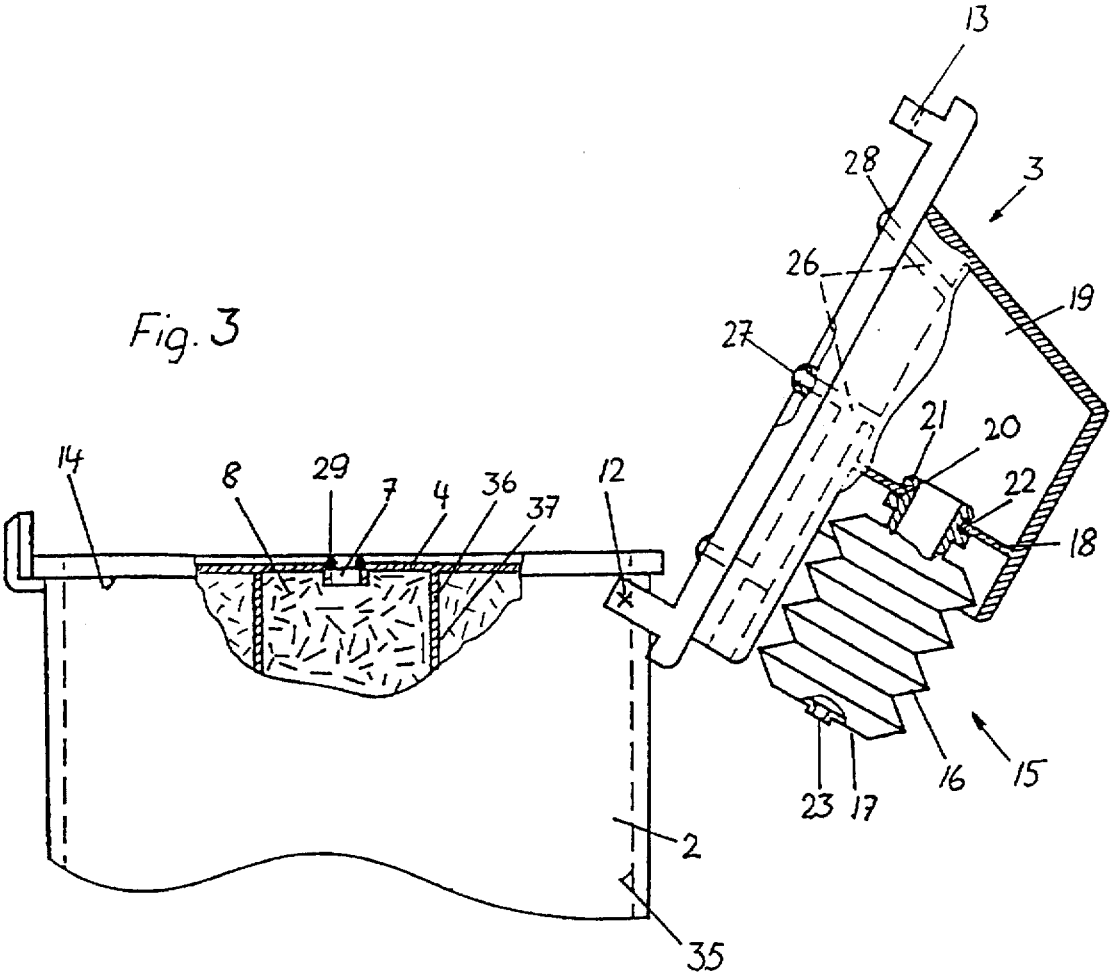
FIG. 3 is a partial sectional elevational view of a multi-color print head for an ink-jet printer shown with the cover in an open position constructed in accordance with a second embodiment of the invention.

In the second embodiment depicted in FIG. 3, analogous parts are identified with the same reference symbols making a detailed description of these parts unnecessary. This embodiment differs from that of FIGS. 1 and 2 in that housing 2 has only a single receiving chamber 35 and an ink cartridge in the form of a single cartridge 4' is divided into individual chambers 37 by partitions 36. This embodiment is especially suitable for applications in which the various colors are consumed relatively evenly over time so that the ink supply in each of chambers 37 is exhausted at approximately the same time. It is then easier to replace a single cartridge 4' instead of in the manner discussed above in connection with the first embodiment.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A multi-color print head for an ink-jet printer comprising a housing having a plurality of receiving chambers, a plurality of ink cartridges each having an ink of a predetermined color in said receiving chambers, each of said ink cartridges having a vent opening for feeding air, and a pump means disposed on said housing and being in fluid communication with said vent opening to create an overpressure at the vent openings after at least one of said ink cartridges has been inserted in one of said receiving chambers.

2. The print head of claim 1, wherein said pump means is a single pump and communicates with each of said vent openings.

3. The print head of claim 2, wherein, said housing includes a cover, said pump means being disposed on said cover.

4. The print head of claim 3, wherein said cover has a plurality of channels, each channel communicating at one end with said pump means and being provided at its other end with a sealing element engaging one of said vent openings in a closed position of said cover.

5. The print head of claim 4, wherein said cover is hinged to said housing and includes a catch means for releasably connecting to said housing.

6. The print head of claim 1, wherein said pump means includes an elastically deformable hollow body having a handle surface, said handle surface including a free through-opening.

7. The print head of claim 6, wherein said hollow body is designed as a bellows.

8. The print head of claim 7, wherein said hollow body is formed from an elastomeric material.

9. A print head for an ink-jet printer comprising:

a housing having at least one inner chamber configured to receive a replaceable ink cartridge by insertion;

a replaceable ink cartridge inserted into the housing and including at least one ink chamber for storing ink, the at least one ink chamber having a vent opening for communicating air into the at least one ink chamber;

an openable and closeable cover attached to the housing such that when opened, the cover providing access into the housing for replacement of the ink cartridge, and when closed, the cover prohibiting access into the housing; and pump means connected to the cover and being in fluid communication with the vent opening to create an overpressure at the vent opening after the ink cartridge has been received into the housing and the cover is closed.

10. The print head of claim 9 wherein said ink cartridge providing at least two chambers for storing inks of different colors, each respective chamber having a separate vent opening for feeding air into each said respective chamber and a pump element supported on said housing to create an overpressure at said vent openings after said ink cartridge means has been inserted in said housing.

11. The print head of claim 10 wherein said pump element is a single pump in fluid communication with each of said vent openings.

12. The print head of claim 10, wherein said cover has a plurality of channels, each channel communicating at one end with said pump element and being provided at its other end with a sealing element engaging one of said vent openings in a closed position of said cover.

13. The print head of claim 12, wherein said cover is hinged to said housing and includes a catch means for releasably connecting to said housing.

14. The print head of claim 10 wherein said pump element includes an elastically deformable hollow body having a handle surface, said handle surface including a free through-opening.

15. The print head of claim 14, wherein said hollow body is designed as a bellows.

16. The print head of claim 15, wherein said hollow body is formed from an elastomeric material.

17. The print head of claim 9, wherein said pump means is a single pump being in fluid communication with said vent opening.

18. The print head of claim 9, wherein said cover has a plurality of channels, each channel communicating at one end with said pump means and being provided at its other end with a sealing element engaging said vent opening in a closed position of said cover.

19. The print head of claim 9, wherein said pump means includes an elastically deformable hollow body having a handle surface, said handle surface including a free through-opening.

* * * * *

UNITED STATES PATENT AND TRADEMARK OFFICE

CERTIFICATE OF CORRECTION

PATENT NO. : 5,724,081
DATED : March 3, 1998
INVENTOR(S) : Gordian Maechler, et al.

It is certified that error appears in the above-indentified patent and that said Letters Patent is hereby corrected as shown below:

On the cover page, below the filing date, insert:

(30) Foreign Application Priority Data

Mar. 16, 1994 (CH) Switzerland . . . . . 774/94-4

Signed and Sealed this

Twenty-eighth Day of July, 1998

Bruce Lehman

*Attest:*

BRUCE LEHMAN

*Attesting Officer*

*Commissioner of Patents and Trademarks*